US009938718B1

(12) United States Patent
Underkofler

(10) Patent No.: US 9,938,718 B1
(45) Date of Patent: Apr. 10, 2018

(54) ARCHED ISLAND CEILING USEFUL IN OPEN PLENUM

(71) Applicant: USG Interiors, LLC, Chicago, IL (US)

(72) Inventor: Abraham M. Underkofler, Salem, WI (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/447,148

(22) Filed: Mar. 2, 2017

(51) Int. Cl.

| | |
|---|---|
| ***E04B 9/22*** | (2006.01) |
| ***E04B 9/24*** | (2006.01) |
| ***E04B 9/04*** | (2006.01) |
| ***E04B 9/06*** | (2006.01) |
| ***E04B 9/18*** | (2006.01) |

(52) U.S. Cl.
CPC ..... *E04B 9/24* (2013.01); *E04B 9/0435* (2013.01); *E04B 9/061* (2013.01); *E04B 9/065* (2013.01); *E04B 9/183* (2013.01)

(58) Field of Classification Search
CPC ..... E04B 9/0435; E04B 9/24; E04B 9/183; E04B 9/061; E04B 9/065
USPC ..... 52/245
See application file for complete search history.

(56) References Cited

U.S. PATENT DOCUMENTS 1,878,812 A * 9/1932 Berger ..... E04B 9/065 138/107
1,997,580 A * 4/1935 Gibson ..... E04B 9/24 52/145
2,693,195 A * 11/1954 Frieder ..... E04B 1/34326 135/122
2,882,558 A * 4/1959 Jacobson ..... E04B 9/16 52/459
3,164,230 A * 1/1965 Adams ..... E04L 39/0478 52/506.09
3,207,057 A * 9/1965 Brown ..... E04B 9/242 454/301
3,375,630 A * 4/1968 Dail ..... E04B 9/065 52/144
3,645,051 A * 2/1972 Kolesar ..... E04B 9/363 52/28
4,040,758 A * 8/1977 Sauer ..... E04B 9/16 403/188
4,115,484 A * 9/1978 Saxton ..... F28F 25/082 261/111
4,463,537 A * 8/1984 Rodriquez ..... E04B 9/225 52/506.07
4,783,946 A * 11/1988 Boegle ..... E04B 9/061 52/506.1
4,991,373 A * 2/1991 Shaub ..... E04B 9/241 411/459
5,265,333 A * 11/1993 Lim ..... E04B 9/36 29/521
5,893,250 A * 4/1999 Benvenuto ..... E04B 9/0478 52/506.06

(Continued)

*Primary Examiner* — Paola Agudelo
(74) *Attorney, Agent, or Firm* — Pearne & Gordon LLP

(57) ABSTRACT

An arched island ceiling system comprising a pair of arcuate frame members, metal panels, and clips for supporting the panels on the frame members, the frame members having a generally rectangular cross-section, the clips having a saddle configuration including a seat and legs depending from opposite sides of the seat and being proportioned to straddle the frame member, lower ends of the legs having feet engageable with the underside of inwardly extending flanges of sides of the metal panels.

12 Claims, 3 Drawing Sheets

(56) References Cited

U.S. PATENT DOCUMENTS

| | | | | |
|---|---|---|---|---|
| 6,298,623 | B1 * | 10/2001 | Wendt | E04B 9/006 248/343 |
| 6,467,228 | B1 * | 10/2002 | Wendt | E04B 9/003 52/145 |
| 6,834,467 | B2 * | 12/2004 | Gulbrandsen | E04L 39/00 52/506.06 |
| 7,013,607 | B1 * | 3/2006 | South | E04B 1/169 264/131 |
| 7,428,801 | B2 * | 9/2008 | Ostenfeldt | E04B 9/0414 52/144 |
| D604,105 | S * | 11/2009 | Metcalfe | D7/388 |
| 8,015,765 | B2 * | 9/2011 | Stackenwalt | E04B 9/0414 52/222 |
| 8,096,089 | B2 * | 1/2012 | Platt | E04B 9/0414 52/316 |
| 8,245,476 | B2 * | 8/2012 | Sergounine | E04F 13/18 52/233 |
| 8,596,009 | B2 * | 12/2013 | Baxter | E04B 9/225 52/220.6 |
| 9,534,383 | B1 * | 1/2017 | Underkofler | E04B 9/0478 |
| 2001/0017010 | A1 * | 8/2001 | Barry | E04D 13/158 52/80.1 |
| 2005/0011150 | A1 * | 1/2005 | Stackenwalt | E04B 9/00 52/311.1 |
| 2006/0101764 | A1 * | 5/2006 | Jankovec | E04B 9/061 52/506.07 |
| 2011/0011023 | A1 * | 1/2011 | Gulbrandsen | E04B 9/065 52/506.07 |

* cited by examiner

FIG. 1
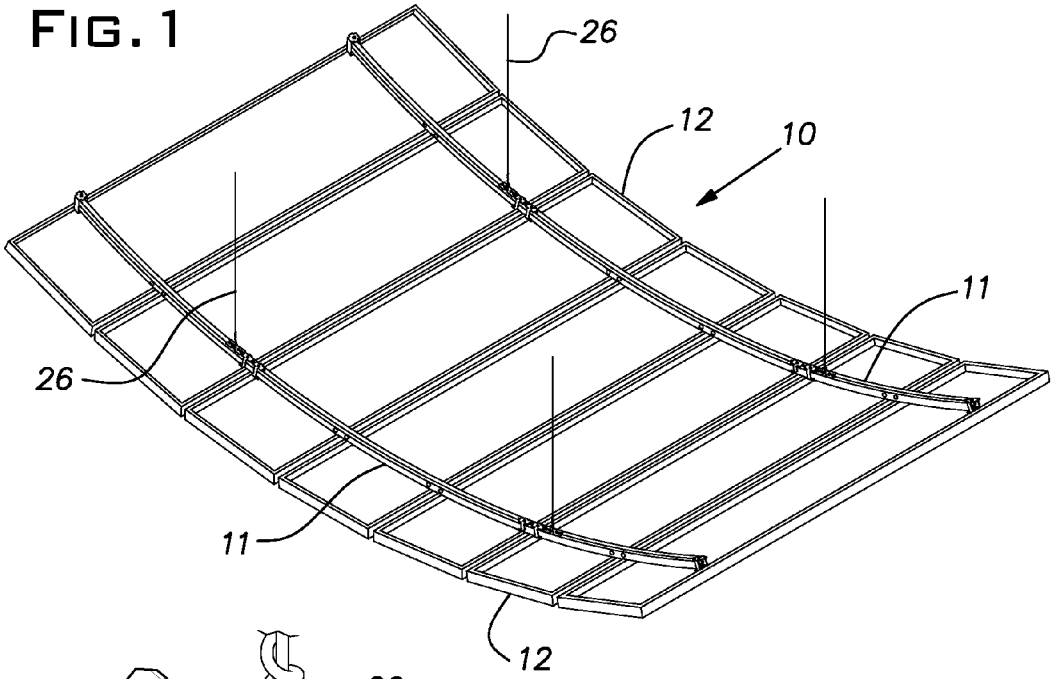
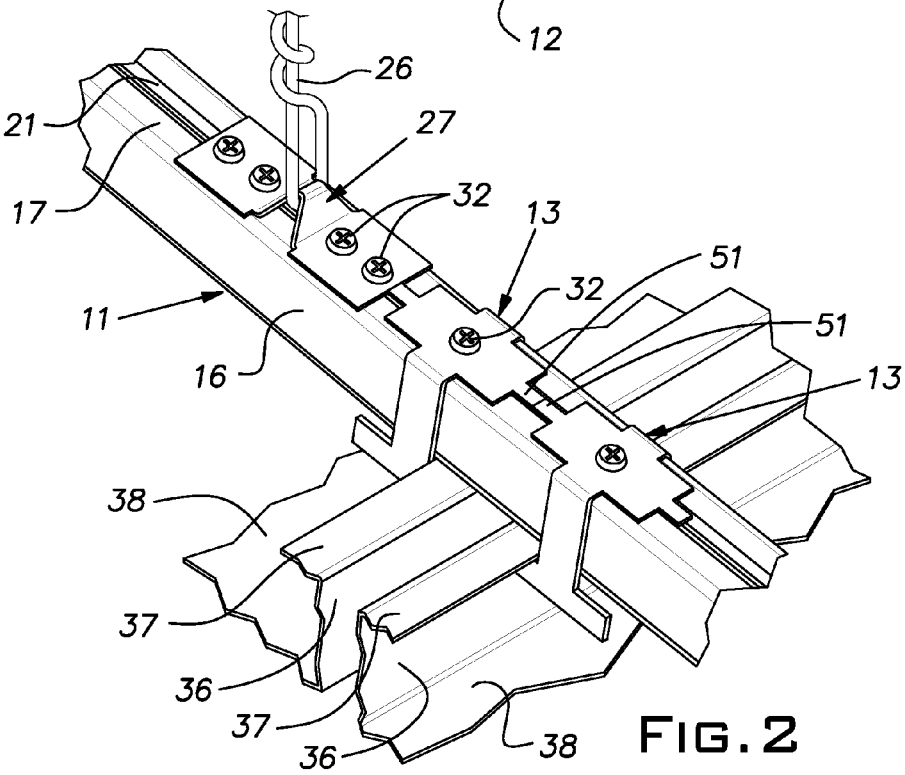
FIG. 2

ARCHED ISLAND CEILING USEFUL IN OPEN PLENUM

BACKGROUND OF THE INVENTION

The invention relates to an island ceiling assembly useful in open plenum structures.

PRIOR ART

Enclosed spaces without a conventional ceiling are sometimes called open plenum areas. These areas are frequently provided with suspended island ceilings which typically are much smaller in area than the overhead structure defining the plenum. There is a need for systems that can provide a look that is distinct from traditional flat ceilings. Ideally, a system should afford a wide combination of shapes, sizes, colors and finishes as well as a choice of curvatures.

SUMMARY OF THE INVENTION

The invention provides an arched island ceiling system that affords a high degree of versatility in curvature as well as in the size, shape, color and finish of panel components. The disclosed system utilizes a horizontally spaced pair of rigid frame members of identical curvature and a plurality of rectangular panels underslung the frame members.

Preferably, the frame members are extruded aluminum elements with a novel rectangular profile. The frame member cross-section has a narrow closed slot on an upper face and an open slot on a lower face. Rectangular pan-like panels are suspended beneath the frame members by clips that straddle the frame members, saddle-like, and engage peripheral in-turned flanges on the panel edges.

The saddle clips are infinitely adjustable and locked along the frame members so that panels of various widths and spacing are readily accommodated. The saddle clips have a hole alignable with the narrow slot at the top of the frame members. A self-drilling screw can be driven through the saddle clip into the narrow slot to assure that the clip is positively locked in place. Hanger clips for attaching a suspension wire can be similarly locked in a desired position on a frame member with screws similarly driven into the narrow slot at the upper face of the frame member.

BRIEF DESCRIPTION OF THE DRAWINGS

FIG. 1 is a perspective view of an arched island ceiling system, from above, embodying the invention;

FIG. 2 is a fragmentary view of hanger saddle clips supporting adjacent panels and a wire attachment clip for suspending the system;

DESCRIPTION OF THE PREFERRED EMBODIMENT

A downwardly curved island ceiling 10 is illustrated in FIG. 1. The ceiling 10 is constructed as a system of rigid elongated frame members 11 and rectangular panels 12 carried below the frame members by saddle clips 13. The panels 12 are arranged perpendicularly to the frame members and, typically, have their ends cantilevered from an adjacent frame member.

Figure 4:
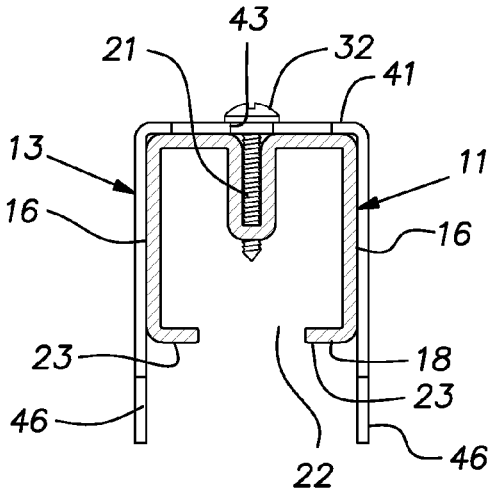
FIG. 4 is a cross-sectional view of a frame member and a saddle clip fastened to the frame member.
Figure 5:
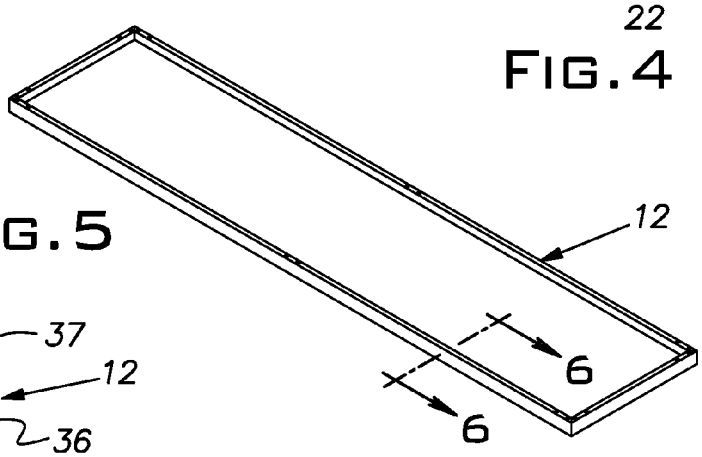
FIG. 5 is a perspective view of a typical panel used in the inventive system.
Figure 6:
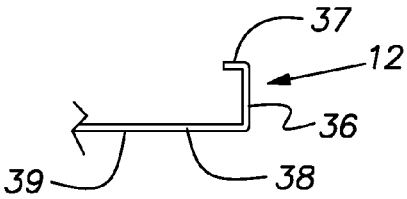
FIG. 6 is an enlarged fragmentary cross-sectional view of the panel of FIG. 5 taken at the lines 6-6 shown in FIG. 5.

The frame members 11 are preferably extruded aluminum rectangular channels, shown in cross-section in FIG. 4. The frame members 11 are formed with a uniform wall thickness of, for example, 0.070 inch and a minimum inside corner radius of, for example, 0.015 inch. The aluminum frame member 11 can be Type 3003 with a Temper T4. The frame member extrusion can be roll formed or otherwise shaped into the convex shape illustrated in FIG. 1 with reference to an observer below the ceiling 10. The illustrative frame members 11 are each curved in a single vertical plane, i.e. represent a two dimensional curve. Side faces 16 of the frame member 11 are flat while the top and bottom faces 17, 18 lie on imaginary cylindrical surfaces of desired radii. For example, the frame members may be arched with a nominal radius, of as small as 5½ feet, or smaller, in convex or concave configurations. The upper or top face 17 has a relatively narrow central slot 21 closed at its bottom or inner end. The lower or bottom face 18 has a slot 22 that opens to the interior of the frame member 11 and result in the formation of two opposed flanges 23 useful for suspending accessories below the island ceiling 10. The frame members 11 can be painted flat white, for example, or can be left natural, or can be painted any other desired color.

Figure 8:
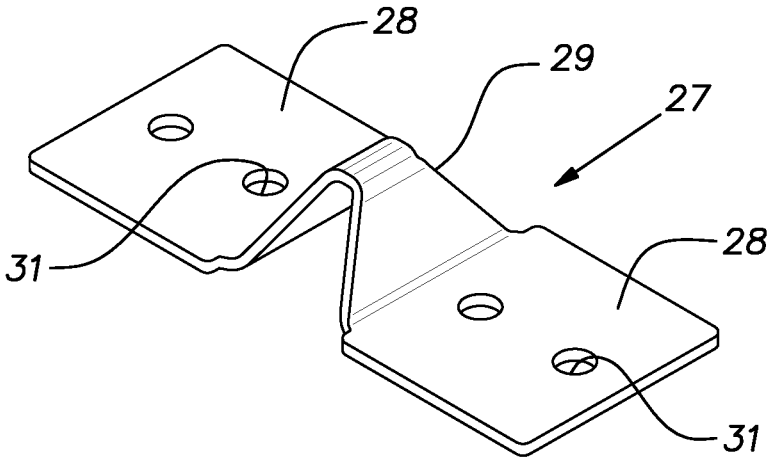
FIG. 8 is an enlarged perspective view of a wire attachment clip.

Ordinarily, the frame members 11 are suspended from superstructure with wires 26 which can be 12 gauge wire, typically used with suspended ceilings. FIG. 8 illustrates a hanger bracket 27 used for attaching a suspension wire to a frame member 11. The bracket 27 can be stamped from 18 gauge hot dipped galvanized (HDG) steel or electrogalvanized steel (EGS). The bracket includes a pair of coplanar plates 28 on opposite sides of a raised, central, reduced width waist section 29. The plates 28 each have a pair of holes 31 for receiving screws 32 to attach the bracket 27 to a respective frame member 11. The screws 32 can be a self-drilling and tapping type sized to thread the walls and to penetrate and thread the closed bottom of the slot 21 in the manner illustrated in FIG. 4. The screws 32 are sufficiently strong to draw the bracket plates 28 into tight engagement with the top 17 of the frame member 11.

The panels 12 are preferably fabricated of sheet metal into flat, rectangular shallow pans. One example of a practical size is 72 inches×16 inches×1½ inch deep. Larger, smaller, narrower and wider proportions can be used. Sidewalls 36 of a panel 12 have inturned flanges 37 of one-half inch width, for example, at their upper edges distal from the panel main body designated 38. The adjacent longitudinal ends of the flanges 37 can be joined with a riveted gusset (not shown) to rigidify the panel 12. Panels 12 can be made of any suitable metal such as aluminum or steel. A lower face 39 of the main body 38 can be painted, brushed, polished, anodized, clad with plastic or otherwise finished. Additionally, the main body 38 can be perforated for acoustical performance and/or aesthetics. Acoustical backing material, known in the art, can be applied to the back or upper side of the main body 38.

Figure 3:
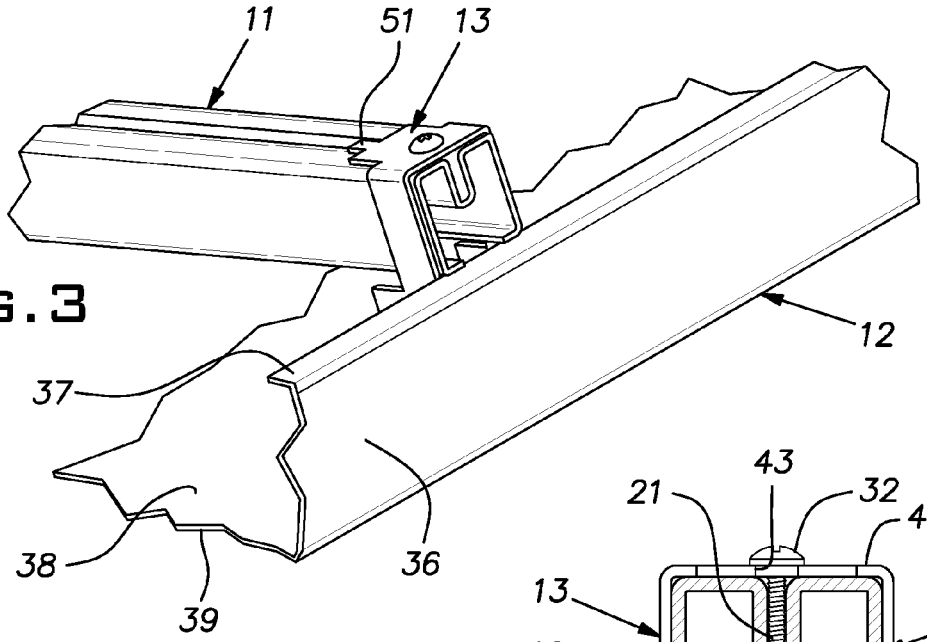
FIG. 3 is a fragmentary perspective view of an edge of the island ceiling.
Figure 7:
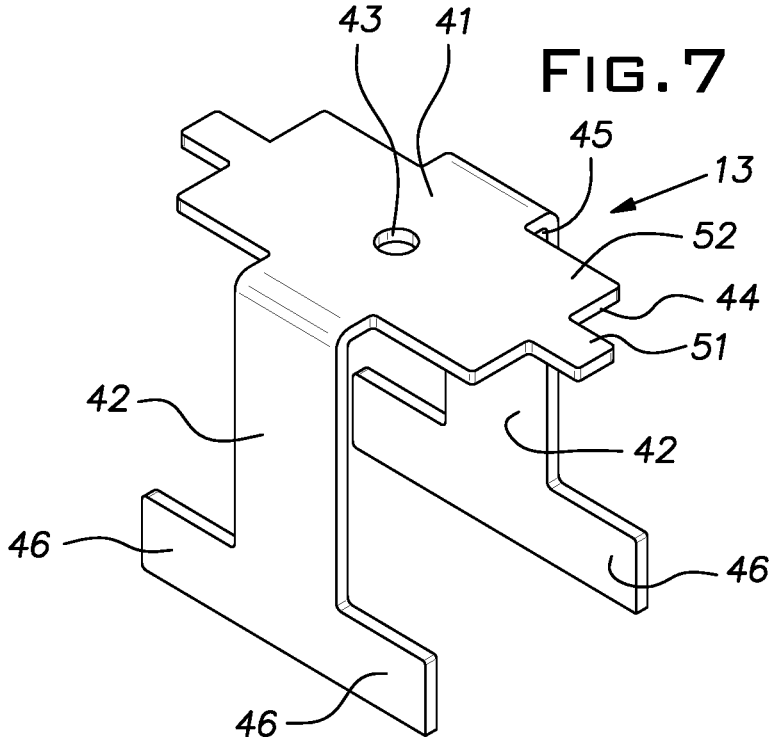
FIG. 7 is an enlarged perspective view of a saddle clip for attaching panels to the frame members.

FIGS. 2 and 3 depict the manner in which the inventive system attaches the panels 12 to the frame members 11 utilizing the saddle clips 13. The saddle clip 13 is shown in larger scale in FIG. 7. A panel attaching saddle clip 13 is shown in larger scale in FIG. 7. The saddle clip 13 can be a sheet metal stamping of, for example, 18 gauge HDG steel or EGS preferably painted to match the frame members 11.

The saddle clip 13 has a flat seat 41 and legs or straps 42 depending from opposite edges of the seat so that the clip exhibits an inverted rectangular U-shaped cross-section such as when viewed in FIG. 4. The seat 41 is elongated in a direction perpendicular to an imaginary line between the straps or legs 42 and has a central hole 43 for receiving a screw 32. The seat 41, in plan view, has steps 44, 45, in its profile that serve as indicia to guide a technician for modification of the clip 13 as explained below. Tabs or feet 46 extend in opposite directions from lower ends of each of the legs 42. The distance from the plane of an underside of the seat 41 to the top of the feet 46 is greater than the height of the frame member and the thickness of the panel flanges 37.

A clip 13 is assembled over a frame member 11 so that its legs 42 straddle the frame member and the seat 42 rests on the top 17 of the frame member. A pair of feet 46, one on each side of the frame member 11, are arranged under the inturned flange 37 of a respective panel 12. When the feet 46 are fully engaged under the flange 37 and the panel 12 is in a desired location under the frame member 11, a screw 32 is assembled in the seat hole 43 and driven into the slot 21 as shown in FIG. 4 so as to thread the walls of the slot and to penetrate and thread the bottom of the slot.

The saddle seat 41 can be modified by a technician at the time an island ceiling is being erected to enable the panels 12 to be accurately positioned relative to one another with a desired spacing or no spacing. A tab 51 at the first step 44 can be left in place and abutted with the tab of an adjacent clip as shown in FIG. 2 for a maximum spacing between panels 12. Larger spacings can be obtained with measurement or use of a spacer between the tabs 51. Smaller spacings can be obtained by cutting off the tab 51 with a tin snips or the like. A still further reduction in spacing can be obtained by removing a larger tab 52 at the step or corner 45. This latter modification is also available to reduce the visibility of the clip 13 at the end of a frame member and the edge of a ceiling as shown in FIG. 3.

The frame members 11 can be produced so that they are concave when viewed from below and can be produced with both convex and concave length portions either in one length or multiple lengths joined end-to-end. The saddle clip 13 is symmetrical about a transverse mid-plane so that it conveniently provides panel support feet 46 regardless of how it is oriented on a frame member 11. Forces on a panel flange 37 at each saddle clip 13 are shared by two spaced feet 46 thereby reducing distortion in the panel. Ordinarily, a panel 12 will be supported by four saddle clips 13 where two frame members 11 are used. Potential over-tightening of a screw 32 securing a saddle clip 13 to a frame member cannot draw the feet 46 into tight engagement with the panel flanges 37 which action could otherwise distort the panel and detract from its appearance.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An arched island ceiling system comprising a pair of arcuate frame members, metal panels, and clips for supporting the panels on the frame members, the frame members having a generally rectangular cross-section, the clips being formed of a sheet metal and having a saddle configuration including a seat and legs depending from opposite sides of the seat and being proportioned to straddle the frame member, lower ends of the legs having feet engageable with the underside of inwardly extending flanges of sides of the metal panels;

wherein the seat is elongated and has a central hole for receiving a screw; and two feet extend in opposite directions away from each other from lower ends of each of the respective legs;

an underside of the seat rests on an upper face of the frame member and;

wherein the upper face of the frame member includes a central screw receiving slot extending lengthwise of the frame.

2. A system as set forth in claim 1, wherein said saddle clip has indicia to guide a technician in changing the length of the saddle by trimming portions thereof from said saddle.

3. A system as set forth in claim 2, wherein said indicia are steps in the transverse width of the saddle seat.

4. A system as set forth in claim 1, wherein said frame members are extruded aluminum.

5. A system as set forth in claim 4, wherein the frame members have an open slot at a lower face bounded by opposed flanges.

6. A system as set forth in claim 4, wherein the hole is configured for receiving a self-tapping screw threaded into said receiving slot.

7. A system as set forth in claim 1, wherein a hanger bracket is attached to the upper face of the frame member.

8. A system as set forth in claim 7, wherein the hanger bracket has preformed holes for receiving multiple screws for attachment to said frame members.

9. A system as set forth in claim 1, wherein the saddle is capable of being used in one of two orientations on a frame member.

10. An arcuate island ceiling comprising a pair of parallel frame members having the same curvature in a respective vertical plane, a plurality of rectangular panels supported by and under the frame members, the lengthwise dimension of the panels being perpendicular to the frame members, a plurality of clips attaching each panel to each frame member, each panel having a pan-shape with a main face and a sidewall on each of four edges, the sidewalls on two lengthwise edges having inturned flanges, the clips being assembled on the frame members and having feet engaging a lower side of the panel sidewall flanges, engagement between a clip and a respective frame member permitting the clip to be located at any selected position on the respective frame member whereby the panels of various widths and various panel spacing can be used with the frame members and clips;

wherein the clips are formed of a sheet metal and have a saddle configuration including a seat and legs depending from opposite sides of the seat and being proportioned to overlie and straddle the frame members, and wherein said seat is elongated in a direction perpendicular to an imaginary line between the legs and has a central hole for receiving a screw; and two feet extend in opposite directions from lower ends of each of the respective legs and wherein the opposite directions run parallel to the length of the frame member.

11. An arcuate island ceiling as set forth in claim 10, wherein the frame members each have a continuous slot on an upper side that receives a screw assembled through a clip at a selected location along the frame member.

12. An arcuate island ceiling as set forth in claim 11, wherein the frame members each have an open slot on their lower faces.

* * * * *